United States Patent [19]

Largeteau

[11] 4,424,648

[45] Jan. 10, 1984

[54] LAPPING TOOLS

[75] Inventor: Pierre A. Largeteau, Bezonz, France

[73] Assignees: S.A. Automobiles Citroen; Societe Automobiles Peugeot, both of Paris, France

[21] Appl. No.: 360,939

[22] Filed: Mar. 23, 1982

Related U.S. Application Data

[63] Continuation of Ser. No. 125,451, Feb. 25, 1980, abandoned.

[30] Foreign Application Priority Data

Nov. 3, 1977 [FR] France ..... 77 33677

[51] Int. Cl.[3] ..... B24B 25/00

[52] U.S. Cl. ..... 51/1; 51/338

[58] Field of Search ..... 51/1, 206 R, 209 R, 51/338, 343, 346, 362, 363, 372, 373, 382, 355, DIG. 6; 125/20

[56] References Cited

U.S. PATENT DOCUMENTS

| | | | |
|---|---|---|---|
| 1,452,769 | 4/1923 | Warner | 51/1 |
| 1,528,653 | 3/1925 | Butler | 51/1 |
| 2,044,474 | 6/1936 | Groetchen | 51/1 |
| 2,146,195 | 2/1939 | Schultz | 51/1 |
| 2,694,277 | 11/1954 | Speck | 51/346 |
| 2,831,297 | 4/1958 | Skran | 51/348 |
| 3,717,956 | 2/1973 | Keutts | 51/1 |

FOREIGN PATENT DOCUMENTS

| | | | |
|---|---|---|---|
| 324184 | 8/1920 | Fed. Rep. of Germany | 51/209 R |

*Primary Examiner*—Harold D. Whitehead

*Attorney, Agent, or Firm*—Karl F. Ross; Herbert Dubno

[57] ABSTRACT

A tool for lapping internal surfaces of holes.

Lapping tools conventionally have an expandable working portion for variable diameter operation. Known tools tend to expand in a barrel shape leading to inaccurate lapping. The invention seeks to avoid this by providing a working portion of a tubular tool with slots in a plurality of rows each having several slots. Slots in each row are staggered relative to those in adjacent rows.

5 Claims, 6 Drawing Figures

LAPPING TOOLS

This is a continuation of application Ser. No. 125,451, filed Feb. 25, 1980 and now abandoned.

BACKGROUND OF THE INVENTION

For lapping a cylindrical hole of small diameter it is general practice to employ a lapping tool constituted by a tube having an expandable working portion which carries diamond cutters externally. Within the tube is provided a cone movable in a sliding motion and integral with a controlling rod. By movement of the cone, the working portion of the lapping tool is expanded.

A lapping tool of this kind normally incorporates, in order to allow the expansion of its working portion, either one longitudinal slot extending from one end of the tube to the other, or a series of alternating longitudinal slots beginning from one end of the tube and terminated at a short distance from the other end. Unfortunately, however, such a lapping tool does not retain a cylindrical form when expanded. It tends to assume a swollen form similar to that of a barrel. Such a shape prevents attainment of a hole of accurate dimensions. To obtain accuracy within half a micron for instance, it is necessary both that each lapping action removes very little material (otherwise the lapping tool is overworked at the end and is worn to a conical shape) and that the lapping tool retains a perfectly cylindrical shape when expanded. An object of the present invention is to provide a lapping tool capable of expansion at its working portion in a relatively uniform manner.

SUMMARY OF THE INVENTION

According to one aspect of the invention, there is provided a lapping tool comprising a tubular member having a working portion at one end thereof, which working portion has an abrasive external surface, a frusto-conical internal surface, and a plurality of slots disposed in parallel rows, the slots of one row being staggered relative to those of an adjacent row, and the tool further comprising a control rod having a frusto-conical portion axially slidable within said working portion whereby the diameter of said working portion is adjustable.

Preferably, said tubular member is elongate and said rows are parallel to the longitudinal axis of the tubular member.

Preferably, said working portion has a diamond-coated external surface.

Preferably, the slots of each row are staggered in relation to the slots in each adjacent row.

Preferably, the tubular member is securable to the control rod for rotation therewith at least for the greater part by means of frictional contact between the frustoconical portion and said frusto-conical inner surface.

In one embodiment, the tubular member is securable to the control rod for rotation therewith solely by means of said frictional contact.

In said one embodiment, said tubular member may be constituted by an abrasive-coated sleeve which is a force fit on said frusto-conical portion.

In a further embodiment, the control rod is slidably keyed to a part of the tubular member, which part is linked to the working portion by a zone of smaller wall thickness.

According to a further object of the invention, there is provided a lapping machine incorporating a said lapping tool, wherein the control rod of the lapping tool is connected to a spindle of the machine in such a way that the frusto-conical portion is fixed against axial movement and the tubular member is connected to an expansion rod of the machine.

Preferably, the tubular member is connected to the expansion rod of the machine by a thread.

Preferably, said tubular member is screwed into a support tube connected to said expansion rod and includes a notched part in engagement with a notched ring slidably mounted on the support tube and immobilised angularly relative to this by resilient means arranged to bias the notches of the ring to a position between the notches of the tubular member.

Preferably, the angular immobilisation of the ring relative to the support tube is produced by a peg extending from the support tube and slidable with its free end in a slot of the ring.

Expediently, the slot is L-shaped and has a portion extending perpendicular to the longitudinal axis of the tubular member which allows the locking of the ring in a position for adjustment of the lapping tool position.

DETAILED DESCRIPTION OF THE PREFERRED EMBODIMENTS

Figure 1:
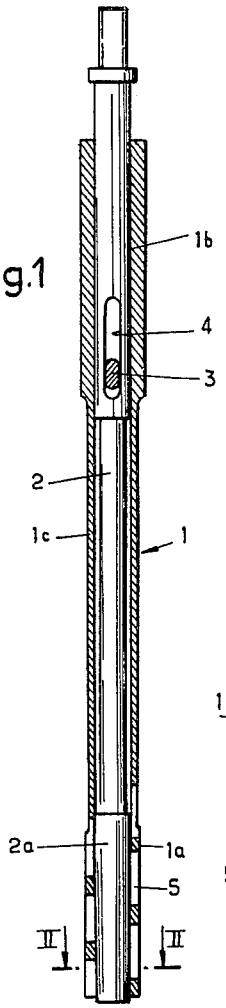
FIG. 1 is an axial sectional view of a first embodiment of lapping tool.
Figure 3:
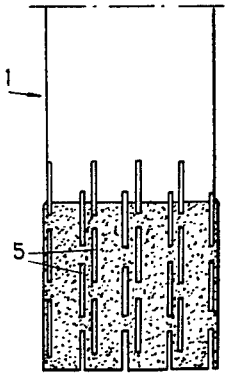
FIG. 3 shows schematically the working portion of the lapping tool in opened-out form.
Figure 4:
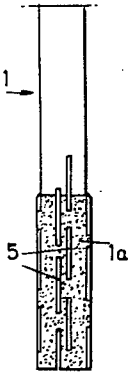
FIG. 4 is a schematic side view of the lapping tool.

FIGS. 1 to 4 show a lapping tool constituted by a tube 1 and an expansion control rod 2 movable within tube 1. At its free end, rod 2 incorporates an externally frusto-conical part 2*a* which bears against an internally frusto-conical part 1*a* of the tube 1. Part 1*a* constitutes the working portion of the lapping tool and is provided externally with a coating of abrasive, e.g. diamond abrasive.

At its end 1*b* remote line part 1*a*, tube 1 is secured for common rotation to rod 2 by a key 3 movable in an elongate slot 4 of the rod. Tube 1 is made with thinner walls in its central part 1*c* positioned between part 1*a* and its end 1*b*, to which a rotational drive is applied.

Part 1*a* incorporates slots 5, formed for instance, by electro-erosion (spark erosion). These are disposed in rows parallel to the longitudinal central axis of the tube in such a way that several separate slots 5 form each row. The slots are alternated, that is to say, each slot is located adjacent an unslotted part interposed between two slots of the adjacent rows. In the example shown, the rows of slots are not evenly spaced but are grouped in pairs, the distance separating the two rows of each pair being less than that separating two adjacent rows belonging to respective neighbouring pairs.

In operation, driving torque is furnished by a spindle of a lapping machine to the expansion control rod 2. This torque is transmitted to the working part 1*a* of the lapping tool, partly via the tube 1 (coupled to rod 2 by key 3) and partly by virtue of the friction between working part 1*a* and the conical part 2*a* of rod 2. This frictional drive is predominant through the effect of the thinning of the part 1*c* which imparts to tube 1 a certain angular flexibility.

When the tube 1 is moved axially upwards relative to the rod 2, working part 1*a* is spread and its diameter increased in a uniform manner throughout its length. It remains perfectly cylindrical externally.

Figure 5:
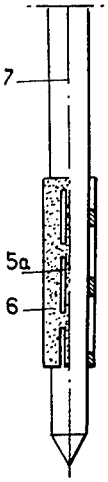
FIG. 5 is a schematic side view, with a partial section of a second embodiment of lapping tool.
Figure 2:
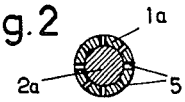
FIG. 2 is a section along line II—II of FIG. 1.

In the embodiment of FIG. 5, the lapping tool is constituted by a simple ring 6 forming a sleeve on a frusto-conical expansion rod 7. Ring 6 incorporates slots 5*a* disposed as the slots 5. The expansion may be obtained by manually forcing the ring 6 onto the rod, and during that operation the ring 6 remains externally perfectly cylindrical. This lapping tool is particularly suitable for use in manual lapping of open holes.

The geometric quality of the lapping tool is enhanced by limiting the stresses on the tube of the lapping tool. This is achieved by causing the tube and control rod to rotate as one body at least predominantly through the friction of the expansion cone within the tube. The lapping tool then has great intertia under the varying stresses of machining, under the stresses of progressive expansion or under variations of contact stresses.

Where the tube of the lapping tool can be connected to the control rod solely through the intermediary of the expansion cone, the tube can be constituted by a simple diamond-encrusted sleeve (FIG. 5) made a forced fit on the expansion cone 8*a*. Expansion is then effected manually by forcing the sleeve onto the cone.

Where the control rod is slidably keyed relative to a part of the tube that is connected to the working part of this same by a zone of reduced wall thickness, this zone imparts an angular suppleness to the tube in such a way that the part of the torque transmitted to this by the cone is greater than that which is transmitted to it through the intermediary of the key.

Figure 6:
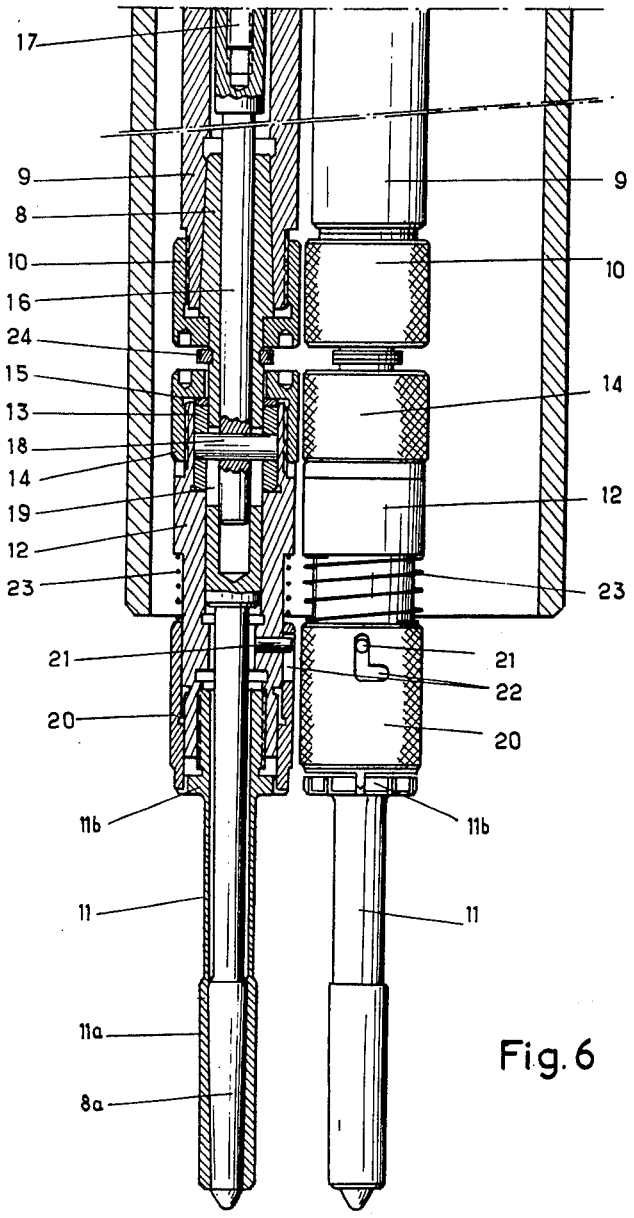
FIG. 6 shows a sectional view of a lapping machine for the simultaneous lapping of holes whose axes are close together.

FIG. 6 shows a plurality of lapping tools fitted to a mass-production automatic machine intended for simultaneous lapping of several closely adjacent holes.

Each lapping tool has an expansion control rod 8 which incorporates in its lower part an expansion cone 8*a* and is fixed directly to a spindle 9 of the machine by a nut 10.

Each lapping tool has a tube 11 which is mounted on the respective expansion cone 8*a* and is screwed into a support tube 12. A linking ring 13 is fitted in the upper part of the support tube 12 and held there by a nut 14 and a washer 15 of plastics material. A draw bar 16 which is screwed onto the expansion rod 17 of the machine is engaged in an axial bore of the rod 8 and secured to the linking ring 13 by a key 18 which passes through draw bar 16, through longitudinal slots 19 of the rod 8 and engages in recesses of linking ring 13.

When the expansion rod 17 rises, it thus takes with it support tube 12 and therefore the tube 11 of the lapping tool which causes radial expansion of the working part 11*a* of the lapping tool by sliding over expansion cone 8*a* which is fixed axially.

Below its threaded part, the tube 11 is provided with a notched collar 11*b*, with which is engaged the notched lower edge of a ring 20 which is fitted over support tube 12 and is secured thereto by a peg 21 secured to support tube 12 and engaged in an L-shaped aperture 22 of ring 20. A compression spring 23 is located between the ring 20 and a shoulder of support tube 12, and tends to hold the notches of ring 20 engaged with those of the collar 11*b*.

To effect an adjustment of the lapping tool, it is totally collapsed by moving the rod 17 upwards, so that it exerts no stress on the tool through the expansion cone 8*a*. Then the ring 20 is moved upwards normally, compressing the spring 23, and the ring is rotated slightly so that the peg 21 is engaged in the horizontal part of the aperture 22, which maintains the ring in its retracted position. Adjustment is then effected by screwing the tube 11 of the lapping tool into or out of the support tube 12. The notched ring 20 is then replaced in its initial position, which fixes the tube 11 in its new position (i.e. prevents rotation of tube 11). The reference 24 identifies a split washer which is enclosed in a channel provided in the upper part of the control rod 8, near the nut 10. When it is desired to retract the control rod 8 from the spindle 9, nut 10 is unscrewed, and bears against the washer 24 thus exerting a force on the rod 8 which extracts it from the spindle 9.

The lapping machine which has just been described makes it possible to obtain continuous expansion of working part 11 during lapping, while driving the tube 11 solely through friction with the expansion cone 8*a*. The lapping tool can be exchanged and adjusted with an excellent degree of precision. This can even be achieved in a cramped space, which makes it possible to produce multiple lapping heads that can operate with very small spacing between the individual lapping tools. It is possible to adjust the lapping tool at any time manually to attain a dimension with very high precision, of the order of 0.5. micron.

It will be seen that the machine just described has the controlling rod of each lapping tool connected to a respective spindle of the machine in such a way that the expansion cone is axially fixed, while the tube of each lapping tool is connected to a respective expansion rod of the machine. Because the tube does not transmit rotation torque, it can be linked to the expansion rod of the machine by a simple thread. This allows the diameter of the working part of the lapping tool to be regulated easily.

It will be understood that the claims are intended to cover all changes and modifications of the preferred embodiments of the invention, herein chosen for the purpose of illustration, which do not constitute departures from the spirit and scope of the invention.

What is claimed is:

1. In a lapping machine comprising a rotatable spindle, a lapping tool connected to said spindle and an axially displaceable expansion rod operable to vary the diameter of said tool, the improvement wherein said tool comprises:

an elongated tubular member having a working portion formed at one end thereof with a substantially cylindrical abrasive external surface and a frustoconical internal surface, at least said working portion being provided with at least one slot throughgoing between said surfaces and elongated along a generatrix;

a control rod having a frustoconical portion axially slidable within said working portion and cooperating with said frustoconical internal surface for adjusting the diameter of said working portion by relative axial displacement of said rod and said member;

means for connecting said tubular member to said expansion rod, said means for connecting said tubular member to said expansion rod including a support tube coaxially surrounding said control rod, a key fixed to said support tube and passing through said expansion rod and longitudinal slots of said control rod and a screwthread coupling between said tubular member and said support tube for axially adjusting said working portion of said tubular member relative to said control rod; and means for fixing said control rod to said spindle to prevent axial movement of the frustoconical portion of said control rod during rotation of said tubular member by said spindle and axial displacement of said expansion rod to adjust the diameter of said working portion.

2. In a lapping machine comprising a rotatable spindle, a lapping tool connected to said spindle and an axially displaceable expansion rod operable to vary the diameter of said tool, the improvement wherein said tool comprises:

an elongated tubular member having a working portion formed at one end thereof with a substantially cylindrical abrasive external surface and a frustoconical internal surface, at least said working portion being provided with at least one slot throughgoing between said surfaces and elongated along a generatrix;

a control rod having a frustoconical portion axially slidable within said working portion and cooperating with said frustoconical internal surface for adjusting the diameter of said working portion by relative axial displacement of said rod and said member;

means for connecting said tubular member to said expansion rod, said means for connecting said tubular member to said expansion rod including a support tube coaxially surrounding said control rod and a screwthread coupling between said tubular member and said support tube for axially adjusting said working portion of said tubular member relative to said control rod; and means for fixing said control rod to said spindle to prevent axial movement of the frustoconical portion of said control rod during rotation of said tubular member by said spindle and axial displacement of said expansion rod to adjust the diameter of said working portion, said support tube being provided with a locking sleeve slidably mounted thereon and formed with an axially projecting finger, a notched collar formed on said tubular member adjacent said sleeve and a resilient member operatively cooperating with said sleeve to displace same relative to said support tube and toward said notched collar for the engagement of said finger therein, said support tube being provided with a peg having a free end slidable in a slot formed in said sleeve for angular immobiliation of said sleeve relative to said support tube, said slot being L-shaped and having a portion extending perpendicular to the longitudinal axis of said tubular member.

3. The improvement defined in claim 2 wherein said at least one slot is a plurality of such slots are provided in said working portion along respective generatrices.

4. The improvement defined in claim 3 wherein said plurality of slots are angularly spaced all around said working portion.

5. The improvement defined in claim 4 wherein a respective row of said slots lie along each generatrix.

* * * * *